US005657702A

United States Patent [19]

Ribeyrolles

[11] Patent Number: 5,657,702

[45] Date of Patent: Aug. 19, 1997

[54] SHELF HAVING SEPARATIONS

[76] Inventor: Alain Marie Rodolphe Ribeyrolles, 12, rue de Normandie, Clamari, France, F-92140

[21] Appl. No.: 513,756

[22] PCT Filed: Mar. 8, 1994

[86] PCT No.: PCT/FR94/00255

§ 371 Date: Sep. 5, 1995

§ 102(e) Date: Sep. 5, 1995

[87] PCT Pub. No.: WO94/20000

PCT Pub. Date: Sep. 15, 1994

[30] Foreign Application Priority Data

| | | | |
|---|---|---|---|
| Mar. 9, 1993 | [FR] | France | 93 02677 |
| Jan. 25, 1994 | [FR] | France | 94 00742 |

[51] Int. Cl.[6] ..... A47B 57/00

[52] U.S. Cl. ..... 108/61; 211/184

[58] Field of Search ..... 108/60, 61; 211/184, 211/43; 246/275.11, 275.12

[56] References Cited

U.S. PATENT DOCUMENTS

| | | | |
|---|---|---|---|
| 767,139 | 8/1904 | De Carli | 108/61 |
| 989,566 | 4/1911 | Callaghan | 108/61 |
| 3,579,710 | 5/1971 | Gartzke | 211/184 X |
| 5,325,792 | 7/1994 | Mulloy | 211/43 X |
| 5,487,518 | 1/1996 | McCraney et al. | 248/225.11 |

FOREIGN PATENT DOCUMENTS

| | | | |
|---|---|---|---|
| 535513 | 1/1957 | Canada | 108/61 |
| 874874 | 7/1971 | Canada | 108/60 |
| 949705 | 9/1956 | Germany . | |
| 1020860 | 12/1957 | Germany . | |
| 1102545 | 3/1961 | Germany . | |
| 2600010 | 7/1976 | Germany | 248/225.21 |
| 844324 | 8/1960 | United Kingdom . | |
| 1209604 | 10/1970 | United Kingdom . | |

*Primary Examiner*—Jose V. Chen

*Attorney, Agent, or Firm*—Greenblum & Blumstein, P.L.C.

[57] ABSTRACT

A shelf having separations, the separations extending upwardly from the shelf. Extending from each of the separations is a respective horizontal portion that rests against the shelf. At least one of the ends of each horizontal portion has a portion that projects against a side of the shelf. An arrangement is provided to apply a force against the projecting portion to thereby lock the separation element in position with respect to the shelf. The locking arrangement includes a locking bar that is positioned within a groove along the shelf and a device for applying a force against the locking bar.

15 Claims, 3 Drawing Sheets

SHELF HAVING SEPARATIONS

BACKGROUND OF THE INVENTION

1. Field of the Invention

The present invention relates to a shelf having separations.

2. Description of Background and Relevent Information

In mass distribution, particularly, one utilizes, to present the products, shelves having parallel separations. Identical products are positioned between two adjacent separations, generally one behind the other.

These shelves comprise a plurality of separations and, as they must receive conditioned products which have different dimensions, it is necessary that they be movable such that it is possible to adjust the distance between two adjacent separations.

Different apparatus have been proposed to allow for, after adjustment, the immobilization of the separations. Experience has shown that these apparatus were not very reliable and were delicate to implement. Furthermore, one of the main disadvantages of these known apparatus reside in the impossibility of precisely adjusting the distance between two separations in a manner such that this distance adapts itself to the dimension of the products.

SUMMARY OF THE INVENTION

British document GB-A-844324 describes a shelf having separations of which each separation has, at one end, a folded back portion in the form of a hook adapted to hook behind an edge of the shelf against which it is pressed. It comes out from this document that each separation is affixed on the shelf independently of one another.

The present invention, which overcomes these disadvantages, is remarkable in that each separation has at one of its ends, at least, one folded back portion, means being provided to act simultaneously against the said folded back portions of all of the separations mounted on the shelf in a manner so as to immobilize the latter.

The folded back portions, or lugs, extend in a groove provided along one of the sides of the shelf and are pressed against either side of the said groove.

BRIEF DESCRIPTION OF THE DRAWINGS

The present invention will be better understood from the description which follows made with reference to the annexed drawings by way of indicative example, only, in which.

DETAILED DESCRIPTION OF THE PREFERRED EMBODIMENTS

Figure 1:
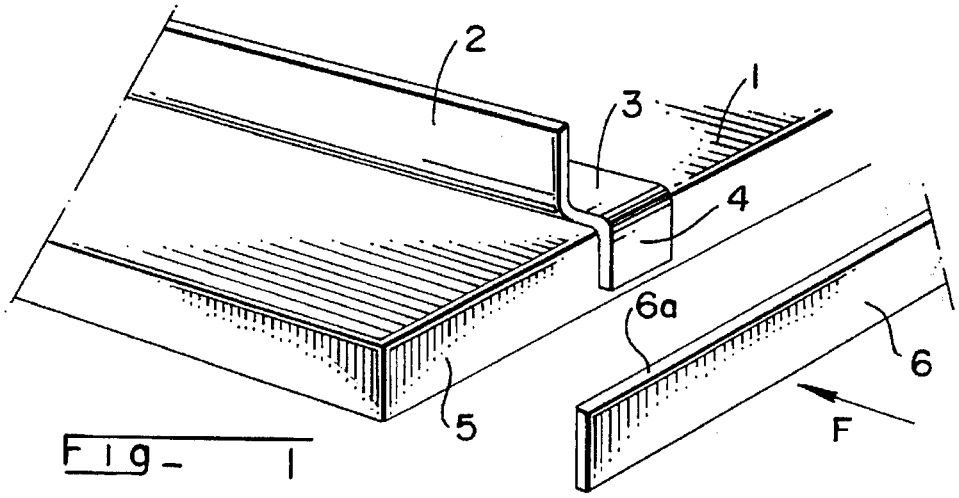
FIG. 1 is schematic view, in perspective, showing the apparatus of the invention.

Referring to the drawings, it is seen that the problem posed consists in immobilizing separations or separation elements such as separations 2 of FIG. 1 on a shelf 1.

According to the invention, this result is obtained by utilizing a separation having, for example, a L-shaped cross section, whose vertical wing constitutes the separation itself and whose horizontal wing 3 rests on the shelf 1, one of the ends, at least, of the wing 3 being curved to form a bracket or lug 4 adapted to extend against the side 5 of shelf 1.

When the spacing between the different separations is adjusted all of the separations are immobilized simultaneously by the application, in pressure, of a locking bar 6.

It should be noted that, as the lug 4 is bent or folded along a line which is perpendicular to the separation, the pressure exerted by the locking bar over all of the lugs tends to press the latter against the side 5 of the shelf. This action, besides assuring the immobilization of all the separations, automatically position the said separations perpendicularly to the side of the shelf.

Figure 2:
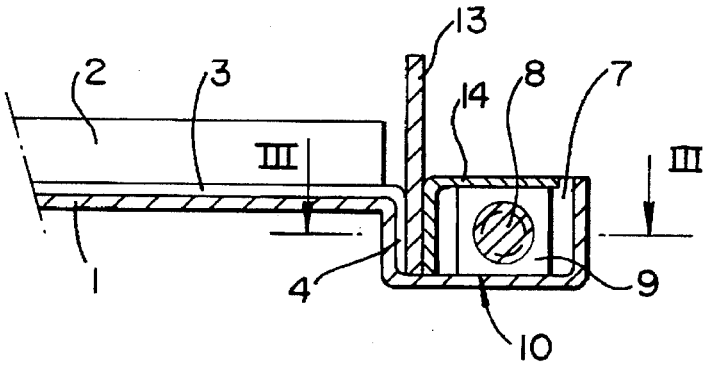
FIG. 2 is a partial view in cross section made along line II—II of FIG. 3.
Figure 3:
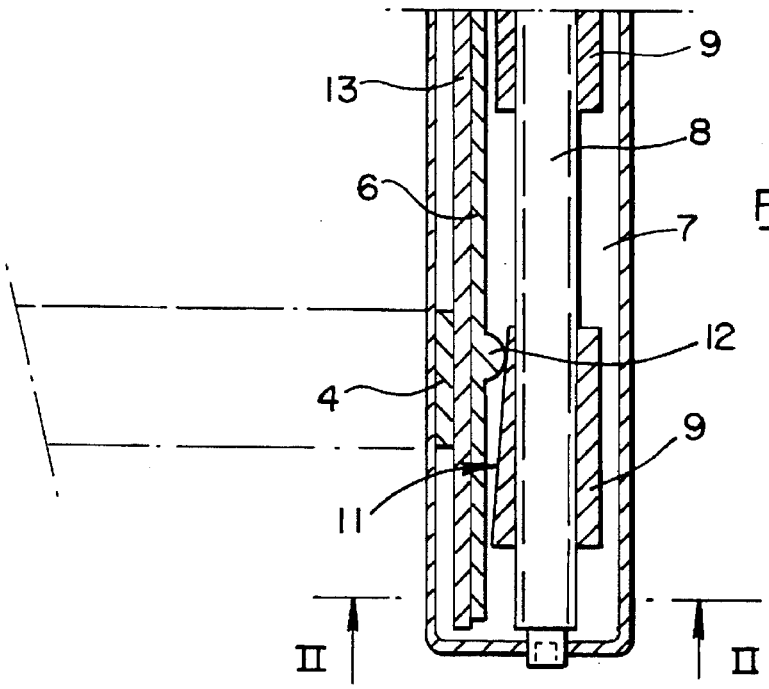
FIG. 3 is cross sectional view made along line III—III of FIG. 2.

FIGS. 2 and 3 illustrate and embodiment of the blocking apparatus of the locking bar 6.

The side 5 of the shelf forms one of the sides of a groove 7 in which is axially immobilized a screw 8 on which are mounted nuts 9 having a plane portion 10 supported against the end of the groove 7. In this manner, when one manipulates the screw 8 the nuts 9 are displaced along its axis.

Each nut has a ramp 11 forming an angle with the locking bar 6 positioned in the groove 7.

The surface of the bar 6 facing nuts 9 has projections 12.

Therefore, one understands that by manipulating the screw 8, it is possible to make the ramps and the or bosses projections 12 cooperate which results in displacing the bar 6 along arrow F of FIG. 1 and to simultaneously press all of lugs 4 against sides 5.

In FIGS. 2 and 3 the control of the rotation of the screw 8 occurs axially by means of a special key of the type of those for screws having hollow heads. As a result, if the different shelves are very close to one another, as is generally the case, the manipulation of the screw 8 can pose problems. The invention envisions thus controlling the screw 8 by means of a bevel gear in a manner such that the locking and unlocking are possible by having access to the apparatus through the front edge of the shelf. Such an embodiment has not been shown because it is within the reach of one with ordinary skills in the art.

When the shelf is inclined, one must provide a means to retain the products. The locking bar can be utilized for this purpose, it suffices for this that its side 6*a* extends above the upper surface of the shelf. This embodiment is not shown.

Another means, to achieve this result, consists in inserting between the lugs 4 and the bar 6 an adjustor 13 whose upper edge extends above the upper surface 6f the shelf.

The locking bar 6 can have along its upper edge a folded back portion 14 which covers and thereby blocks groove 7 when the said bar is in place.

The displacement of the bar 6 can be obtained by a rotating element such as a shaft, provided with cams, positioned in the groove 7.

Figure 4:
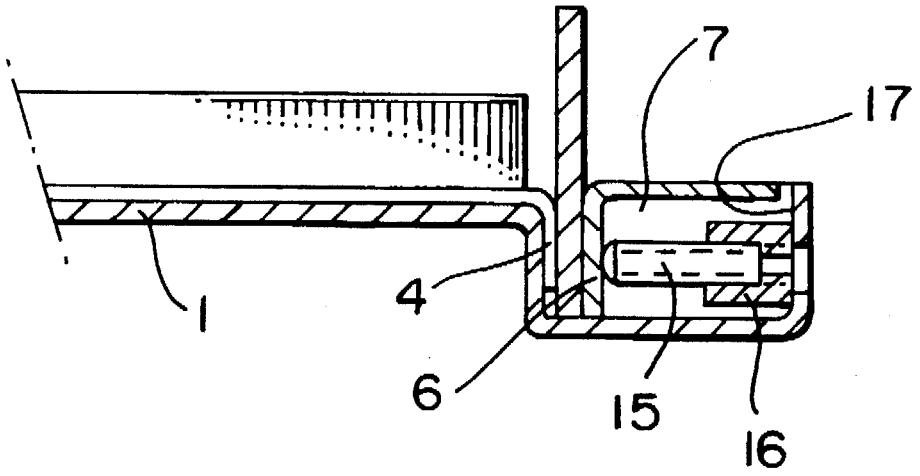
FIG. 4 is a view, analogous to FIG. 2, showing an alternative embodiment.
Figure 5:
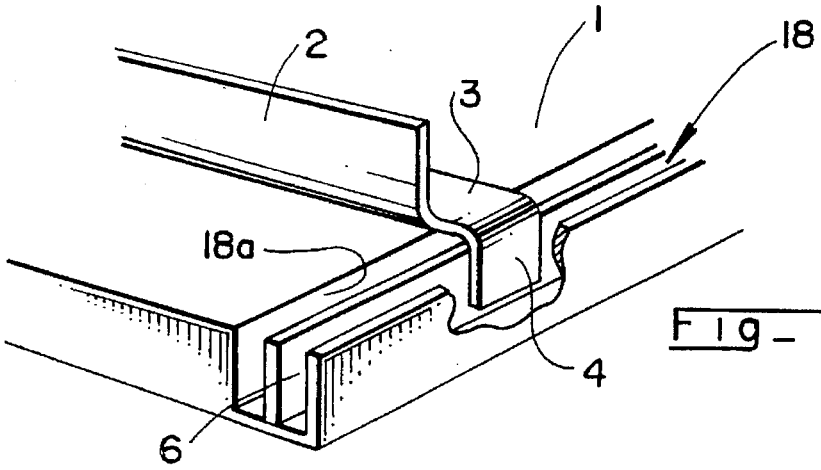
FIG. 5 is a view, analogous to that of one, showing another embodiment.

The displacement of the bar 6 can also be obtained, as shown in FIG. 4, by pressure screws 15 engaged in the nuts 16 affixed to the internal surface 17 of the front edge of the groove 7. The apparent edge of each screw can have a recess preventing the manipulation of the screw except by means of a special key to avoid vandalism.

According to another embodiment, one of the edges of the shelf 1 has a groove 18 into which extend the lugs 4 and where the locking bar 6 is positioned, the said bar being interposed between the said lugs 4 and the side 18*a* of the groove adjacent to the edge of the shelf, means being provided to displace the bar 6 along the arrow $F_1$ in a manner so as to press the lugs 4 against the other or opposed side 18*b* of the groove 18 formed by an upstanding side member extending along and spaced apart from the side 18*a*.

The bar 6 is made affixed to a shaft 19 extending through the side 18*b* of the groove 18. By exerting a traction on the shaft 19, along the arrow $F_1$, one displaces the bar 6 in the same direction and one presses the lugs 4 against the side 18*b*.

Figure 8:
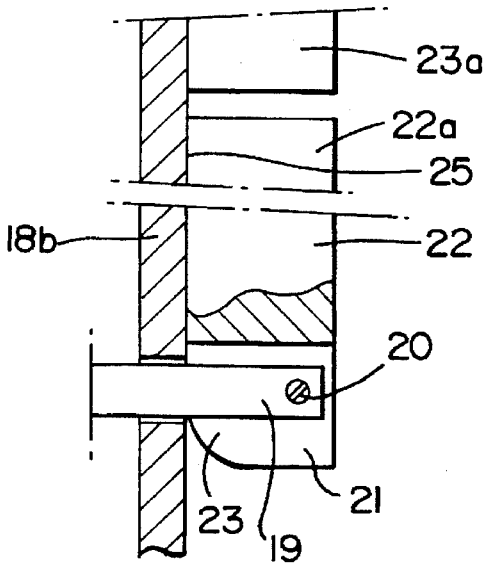
FIG. 8 is a view analogous to FIG. 7, the movable elements being shown in a position in which the lugs are locked.
Figure 7:
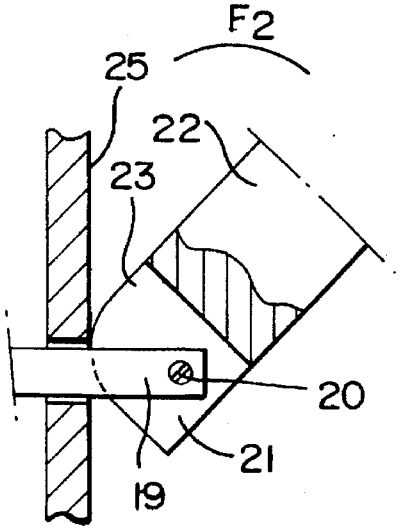
FIG. 7 is a partial view, on a larger scale, made along line VII—VII of FIG. 6, the movable elements being shown in a position along which the locking bar is not applied against the lugs.

The end of the shaft 19 is journalled, by interpositioning a spindle or pin 20, between the wings of a clevis 21 positioned at the end of a lever 22 and configured to constitute a cam 23, as shown in FIGS. 7 and 8.

When the lever 22 is in the position shown in FIG. 7, the locking bar is not applied against the lugs 4 and, at this moment, one can adjust the distances between the different separations shown on the shelf.

If, from this position, one pivots the lever 22 along the arrow $F_2$, one displaces the shaft 19 along the arrow $F_1$, under the action of cam 23.

In practice, each locking bar has two shafts 19 and levers 22 are positioned in a manner such that their ends 22*a* are facing when the lugs 4 are latched (FIG. 8). In this position it is easy to block the pivoting of the two levers by means of a lock which is manipulable by a key (not shown).

If the shaft 19 crosses freely the bar 6 and is provided with a head 19*a*, a spring 24 is interposed between the said bar and the side 18*b*.

To avoid that the levers pivot around the axes of the shafts 19, the ends of the axes 20 are guided between the wings of a cap whose median portion, which is traversed by the said shaft 19, is affixed against the external surface 25 of the side 18*b*.

Figure 6:
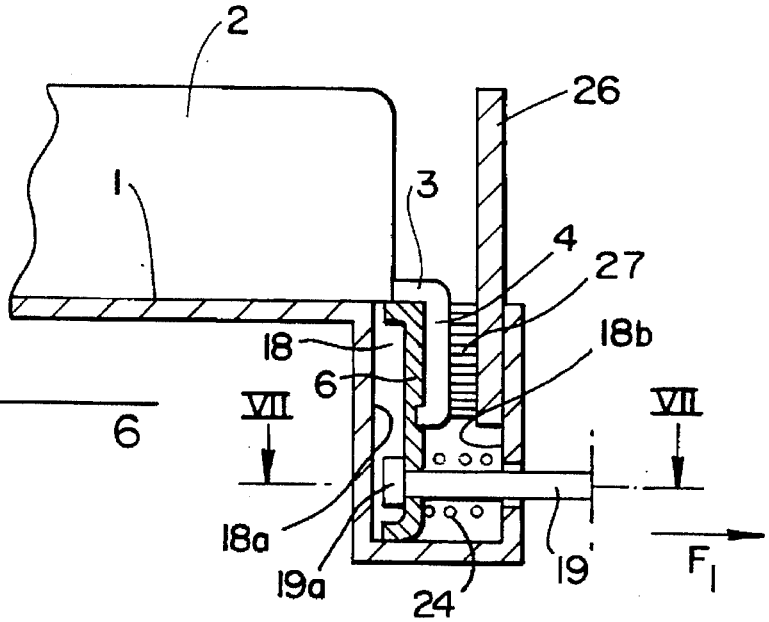
FIG. 6 is a partial view, in transverse cross section, of the shelf of FIG. 5.

As can be seen in FIG. 6, bar 6 can be utilized to maintain an adjustor 26, analogous to adjustor 13. The width of the lower portion of this adjustor can be doubled by means of a band 27 formed out of an elastically deformable material.

It should be noted that the separations can have any cross section: "T", square, etc.

It should be noted, also, that the separations can be hollow and form boxes, provided or not with a bottom, resting on the shelf.

Finally, the separations can have a lug at each of their ends. In this case, the locking bar is displaced in a manner so as to press the lugs against the side of the shelf opposite side 5. The means described with reference to FIGS. 5–8 can be utilized for this purpose, it being well understood that, in this case, the lugs subjected directly to the action of bar 6 are not applied against the edge 18*b* of the groove.

I claim:

1. A shelf and separation assembly, said assembly comprising:

a shelf having an outer surface, at least one side surface and a groove extending along said side surface;

at least one separation element having a first portion extending along said outer surface of said shelf and having a second portion projecting from said outer surface of said shelf, said separation element further comprising an end, said end of said separation element being bent with respect to said first portion of said separation element, said end extending along said side surface of said shelf and projecting into said groove; and an arrangement for applying a force against said end of said at least one separation element for locking said at least one separation element in position with respect to said shelf, said arrangement comprising a locking bar positioned within said groove and a device for applying a locking force to said locking bar, said device including a structure adapted for manipulation to apply said locking force to said locking bar in a direction against said side surface of said shelf.

2. An assembly according to claim 1, wherein:

said groove is defined by said side surface of said shelf and a further surface extending substantially parallel to said side surface; and said device for applying a locking force against said locking bar comprises a device for pressing said end against one of said side surface of said shelf and said further surface.

3. A shelf assembly comprising a kit of parts comprising:

a shelf having an outer surface, at least one side surface and a groove extending along said side surface;

at least one separation element having a first portion adapted to be assembled to extend along said outer surface of said shelf and having a second portion adapted to be assembled to project from said outer surface of said shelf, said separation element further comprising an end, said end of said separation element being bent with respect to said first portion of said separation element, said end being adapted to be assembled to extend along said side surface of said shelf and to project into said groove; and an arrangement for applying a force against said end of said at least one separation element for locking said at least one separation element in position with respect to said shelf, said arrangement comprising a locking bar adapted to be assembled to be positioned within said groove and a device for applying a locking force to said locking bar, said device including a structure adapted for manipulation to apply said locking force to said locking bar in a direction against said side surface of said shelf.

4. A shelf having separation elements comprising:

a shelf having at least one side surface and a groove extending along said side surface, said groove being defined by a pair of side surfaces, one of said side surfaces of said groove being said side surface of said shelf;

a plurality of separation elements positioned on said shelf, each separation element having a pair of ends, one of said ends of each separation element being bent to form a bracket that extends along said side surface of said shelf and projects into said groove;

a locking bar positioned within and extending along said groove and along said brackets of said plurality of separation elements; and a device for applying a locking force to said locking bar, said device including a structure for applying a locking force to said locking bar and to said brackets of said separation elements in a direction against a side surface of said groove to thereby lock said separation elements in place with respect to said shelf.

5. A shelf according to claim 4, wherein:

said structure of said device for applying a locking force to said locking bar comprises an element mounted for rotation.

6. A shelf according to claim 4, wherein:

said groove has a side defined by said side surface of said shelf;

said locking bar comprises a plurality of bosses spaced apart along said locking bar;

said structure of said device for applying a locking force to said locking bar comprises a screw positioned within and extending along said groove, a plurality of nuts within which said screw is in threaded rotatable engagement, said nuts being mounted against rotation, each of said nuts having a ramp engaged with a respective one of said bosses for applying said locking force to said locking bar upon rotation of said screw.

7. A shelf according to claim 4, wherein:

said shelf has an upper surface on which said separation elements are positioned; and said locking bar has an upper edge extending above said upper surface of said shelf.

8. A shelf according to claim 4, wherein:

said locking bar has an upstanding portion, against which said locking force is applied, and a portion bent over and covering said groove.

9. A shelf according to claim 4, wherein:

said structure of said device for applying a locking force to said locking bar comprises at least one adjusting screw positioned transversely in said groove.

10. A shelf according to claim 9, wherein:

said at least one adjusting screw comprises a plurality of using screws spaced apart along said groove.

11. A shelf according to claim 4, wherein:

a second of said pair of side surfaces of said groove is defined by an opposed surface of an upstanding side member, said opposed surface being spaced apart and extending along said side surface of said shelf;

said locking bar is positioned adjacent said side surface of said shelf and interposed between said side surface of said shelf and said brackets of said separation elements; and said structure of said device for applying a locking force to said locking bar comprises means for applying said locking force to said locking bar and to said brackets of said separation elements in a direction against said opposed surface of said groove thereby lock said separation elements in place with respect to said shelf.

12. A shelf according to claim 11, wherein:

said means for applying said locking force to said locking bar includes at least one rod extending through said upstanding side member and being attached to said locking bar, said rod being adapted to be subjected to a traction force to pull said rod in a direction from said side surface of said shelf toward said opposed surface.

13. A shelf according to claim 12, wherein:

said rod comprises an end extending beyond said upstanding side member;

said means for applying a locking force to said locking bar further comprises:

a lever having an end with a pair of wings forming a clevis, said end of said rod extending between said wings of said clevis; and a pin extending through said end of said rod and to each of said wings to thereby articulate said lever with respect to said rod;

said wings of said clevis being shaped to form a cam for engagement with said upstanding side member as said lever is articulated with respect to said rod.

14. A shelf according to claim 11, wherein:

said means for applying said locking force to said locking bar includes two rods extending through said upstanding side member and being attached to said locking bar, each of said rods being adapted to be subjected to a traction force to pull said rods in a direction from said side surface of said shelf toward said opposed surface;

both of said rods having a respective end extending beyond said upstanding side member;

said means for applying a locking force to said locking bar further comprises:

two levers, each said lever having an end with a pair of wings forming a clevis, said end of each respective rod extending between said wings of a respective clevis; and a pin extending through a respective one of each of said ends of said rods and to each of said wings of a respective clevis to thereby articulate said levers with respect to a respective rod;

said wings of each of said clevises being shaped to form a cam for engagement with said upstanding side member as each said lever is articulated with respect to a respective rod between a latched position and an unlatched position, whereby in said latched position, said locking force is applied to said opposed surface and to said brackets of said separation elements; and each of said two levers having a respective free end and said levers are oriented with respect to said side surface so that, in said latched position, said free ends of said two levers face each other.

15. A shelf according to claim 4, wherein:

said structure for applying a locking force to said locking bar comprises a member adapted to be manipulated between a locking position, thereby said locking force is applied, to an unlocking position.

* * * * *